US008128465B2

(12) United States Patent
Collins

(10) Patent No.: US 8,128,465 B2
(45) Date of Patent: Mar. 6, 2012

(54) AIR DISPLACING DEVICE

(75) Inventor: Peter Collins, Witney (GB)

(73) Assignee: Airdri Limited, Witney, Oxon (GB)

( * ) Notice: Subject to any disclaimer, the term of this patent is extended or adjusted under 35 U.S.C. 154(b) by 718 days.

(21) Appl. No.: 12/147,706

(22) Filed: Jun. 27, 2008

(65) Prior Publication Data

US 2009/0004962 A1 Jan. 1, 2009

(30) Foreign Application Priority Data

Jun. 29, 2007 (GB) ..... 0712727.7

(51) Int. Cl.
*F24F 7/02* (2006.01)

(52) U.S. Cl. ..... 454/252; 454/305; 34/202; 34/91

(58) Field of Classification Search ..... 454/252, 454/253, 188, 189, 190, 191, 192, 341, 305; 34/89, 259, 202
See application file for complete search history.

(56) References Cited

U.S. PATENT DOCUMENTS 1,961,612 A * 6/1934 Knight ..... 454/305
2,634,514 A * 4/1953 Clemens ..... 34/202
3,479,947 A * 11/1969 Myers ..... 454/344
4,993,172 A * 2/1991 Allen ..... 34/202
6,050,000 A * 4/2000 Curzon ..... 34/572
2006/0026936 A1 * 2/2006 Paumier et al. ..... 55/473
2010/0101100 A1 * 4/2010 Hansen et al. ..... 30/355

* cited by examiner

*Primary Examiner* — Steven B McAllister
*Assistant Examiner* — Brittany E Towns
(74) *Attorney, Agent, or Firm* — Davis & Bujold, P.L.L.C.

(57) ABSTRACT

An air displacing device for transferring air from a first location to a second location comprising a housing including a fan, a prime mover for the fan, means defining an air inlet to receive air from the first location, and an air outlet to deliver air to the second location and a duct for air through the housing from the inlet to the outlet, the fan being operable by way of the prime mover to cause air to be displaced along the duct from the inlet to the outlet, the housing serving to define a datum plane characterized in that the housing has external members adapted for displacement between a first, standby, configuration where the projection of the housing from the datum plane is a minimum and so the volume of the housing is a minimum and a second, working, configuration where the projection of the housing from the datum plane is a maximum and so the volume of the housing is a maximum. The invention is particularly applicable for hand driers but is also applicable to other air moving devices such as vacuum cleaners, air conditioning units and drying apparatus for objects other than hands.

12 Claims, 4 Drawing Sheets

AIR DISPLACING DEVICE

This application claims priority from British Application Serial No. 0712727.7 filed Jun. 29, 2007.

TECHNICAL FIELD

This invention relates to an air displacing device. It is particularly, though not exclusively, concerned with a drier for use in a wash room for use by an individual for hand drying. Such a drier is widely used and are generally equipped for automatic operation when, for example, a pair of hands is detected by the drier in a region adjacent the drier. Such a drier is conveniently located on a wall in a wash room or other location. However the invention is not limited to such an application but can be applied to other air moving devices including, but not limited to, vacuum cleaners, air conditioning units and drying apparatus.

A typical air displacing device is a hand drier made up of a housing enclosing a fan drivable by an electric motor, a heater and a passage for air through the casing from an inlet through which ambient air is drawn by the fan for subsequent emission from an outlet. While passing through the passage the displaced air has heat transferred to it by way of a heater. The housing further contains components for regulating operation of the fan and heater and for detecting the presence of hands at a location outside the casing in the vicinity of the outlet. To contain this range of items can result in the housing projecting to an extent that it impinges on freedom of movement or access. This has now become a significant matter in certain countries. Typically there is now an obligation in the United States, under the Americans with Disabilities Act, that in particular locations a wall mounted unit is required to extend no more than 4 inches from a wall on which it is mounted. For an air moving device such as a drier this can cause a design constraint.

BACKGROUND ART

This design constraint has previously been overcome in two ways. Firstly by cutting out a section of the wall such that part of the housing can be set into the wall so reducing the distance by which the heater projects into the room space. The Applicant market a 'recessed' hand drier which installs with the housing half in and half out of wall, The installation of such a heater is a relatively complicated matter requiring advanced planning including the cutting of the wall section as against the relatively simple provision of a wall mounted device.

Secondly by scaling down the internal components to be contained in the housing so as to give a reduction in the required size of the housing. Such a reduction can result in the functional performance being degraded. For example the fan size has to be reduced and consequently the amount of air that can be displaced by the fan and its output speed is reduced. A number of manufacturers each include in their ranges a very shallow dryer whose performance is reduced by comparison with their top performing conventionally housed models.

DISCLOSURE OF INVENTION

According to the present invention there is provided an air displacing device for transferring air from a first location to a second location comprising a housing including a fan, a prime mover for the fan, means defining an air inlet to receive air from the first location, and an air outlet to deliver air to the second location and a duct for air through the housing from the inlet to the outlet, the fan being operable by way of the prime mover to cause air to be displaced along the duct from the inlet to the outlet, the housing serving to define a datum plane characterised in that the housing has external members adapted for displacement between a first, standby, configuration where the projection of the housing from the datum plane is a minimum and/or the volume of the housing is a minimum and a second, working, configuration where the projection of the housing from the datum plane is a maximum and/or the volume of the housing is a maximum.

According to a first preferred version of the present invention there is provided a drier comprising the air displacing device and incorporating means for heat transfer into air displaced along the duct by means of the fan. Typically the drier incorporates means providing for the drier to have a minimum outside dimension when the housing is in its standby configuration and a maximum outside dimension when the housing is in its working configuration. Preferably the displacement of the housing from the standby configuration to the working configuration is caused by operation of the fan.

Alternatively the displacement of the housing from the standby configuration to the working configuration is caused by displacement means other than the fan.

The requirements for limited projection of the housing allow for apparatus that is in use to exceed the projection restriction for apparatus that is not in use. Until now a hand dryer has been considered apparatus where there is no possibility for the space the apparatus occupies to vary depending on whether it is being used or not. The invention provides for a stowed state that satisfies the special regularity requirements and action taking the dryer in and out of (stowage) hibernation on activation such that it takes up a form that is optimised for operating performance.

This is achieved by collapsing the ducts that channel air when the unit is active to reduce the space the said components occupy when in standby mode. As the internal space required by the air moving components is collapsed, the enclosure also reduces in size accordingly such that the enclosure meets the regulatory requirements.

Several mechanisms could be utilised to effect such a transformation, the most simple of these would be implemented by manual operation using a handle, latch and latch release mechanism. In addition an automatic means could be implemented using a motor, gear rack and pinion.

Further to these basic methods an additional automatic method harnesses the motive force of the pressurised fluid. This acts on a surface to achieve expansion. Since the device already has a means to be energised the solution can be implemented without any additional power source or actuation system.

BRIEF DESCRIPTION OF DRAWINGS

An exemplary embodiment of the invention will now be described with reference to the accompanying drawings of a wall mounted hand drier of which.

MODE FOR CARRYING OUT THE INVENTION

Figure 1:
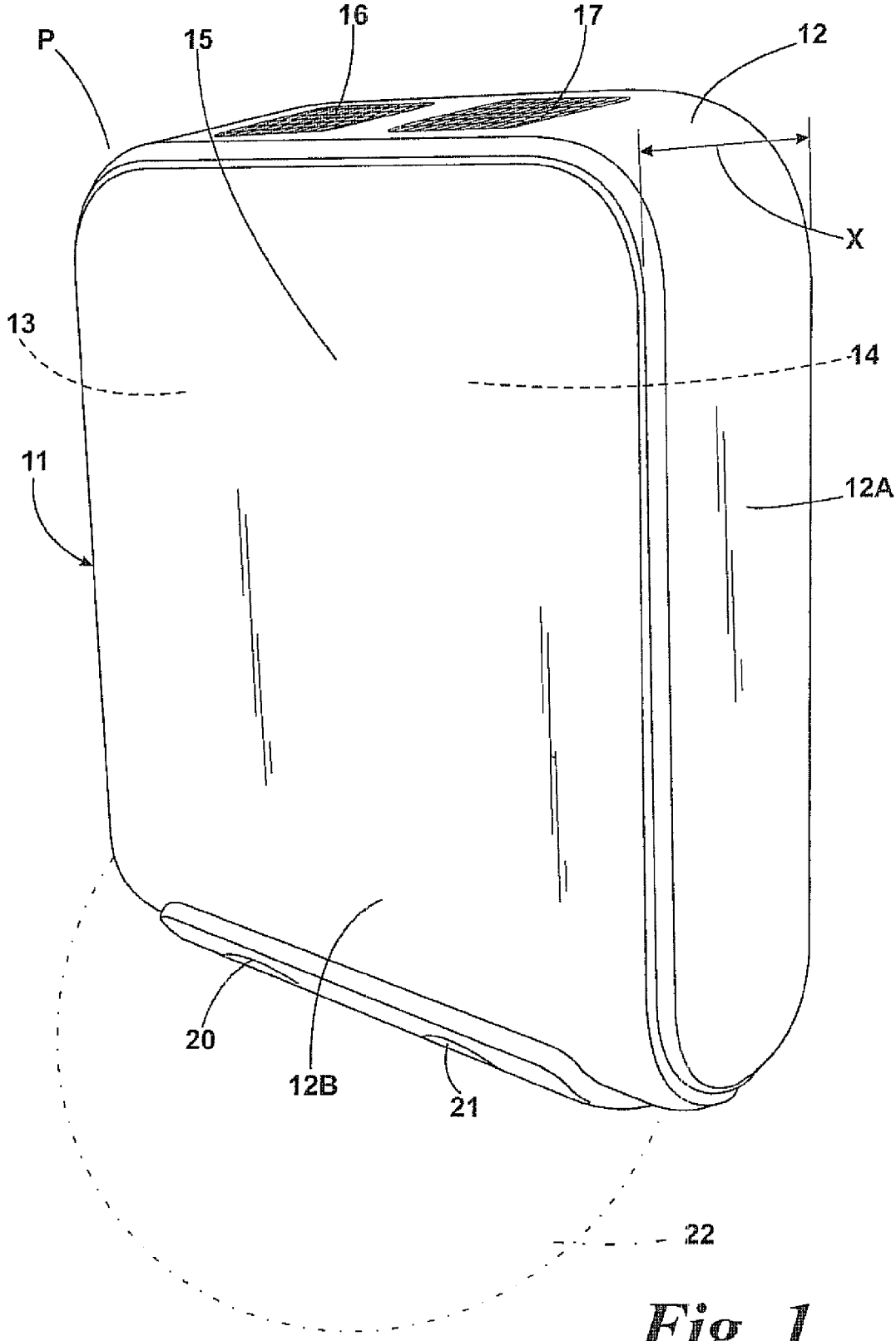
FIG. 1 is a diagrammatic view from the front and to one side (with a partially ghosted interior) to show the internal disposition of components with the drier in standby configuration.

The figures variously show a drier 11 with a housing 12 containing two fans 13, 14 driven by a common electric motor 15. The drier 11 is mains powered.

The housing 12 has air inlets 16, 17 linked by separate air ducts 18, 19 to, respectively, air outlets 20, 21. Duct 18 incorporates the fan 13. Duct 19 incorporates fan 14. Each duct 18, 19 is in a good heat exchange relationship with heating means not shown, Heated air from the outlets 20, 21 is directed into a drying region 22 into which hands or other items for drying are placed.

The drier 11 incorporates monitoring and control devices (not shown) so that on detecting that the drying region 22 is occupied the motor 15 is energised to cause heated air to be emitted from outlets 20, 21 for a predetermined period. Safety devices are also incorporated in the drier to provide for safe operation. Typically they would provide for automatic switching off the system if either or both of the air inlets 16, 17 were blocked or if internal overheating was detected.

The drier 11 defines a datum plane P lying in a surface plane of wall W on which the drier 11 is mounted.

The housing 12 includes: a fixed section 12A which projects from the plane P by a maximum amount X; and a hinged section 12B shown pivoted outwardly at the lower end of fixed section 12A.

Figure 2:
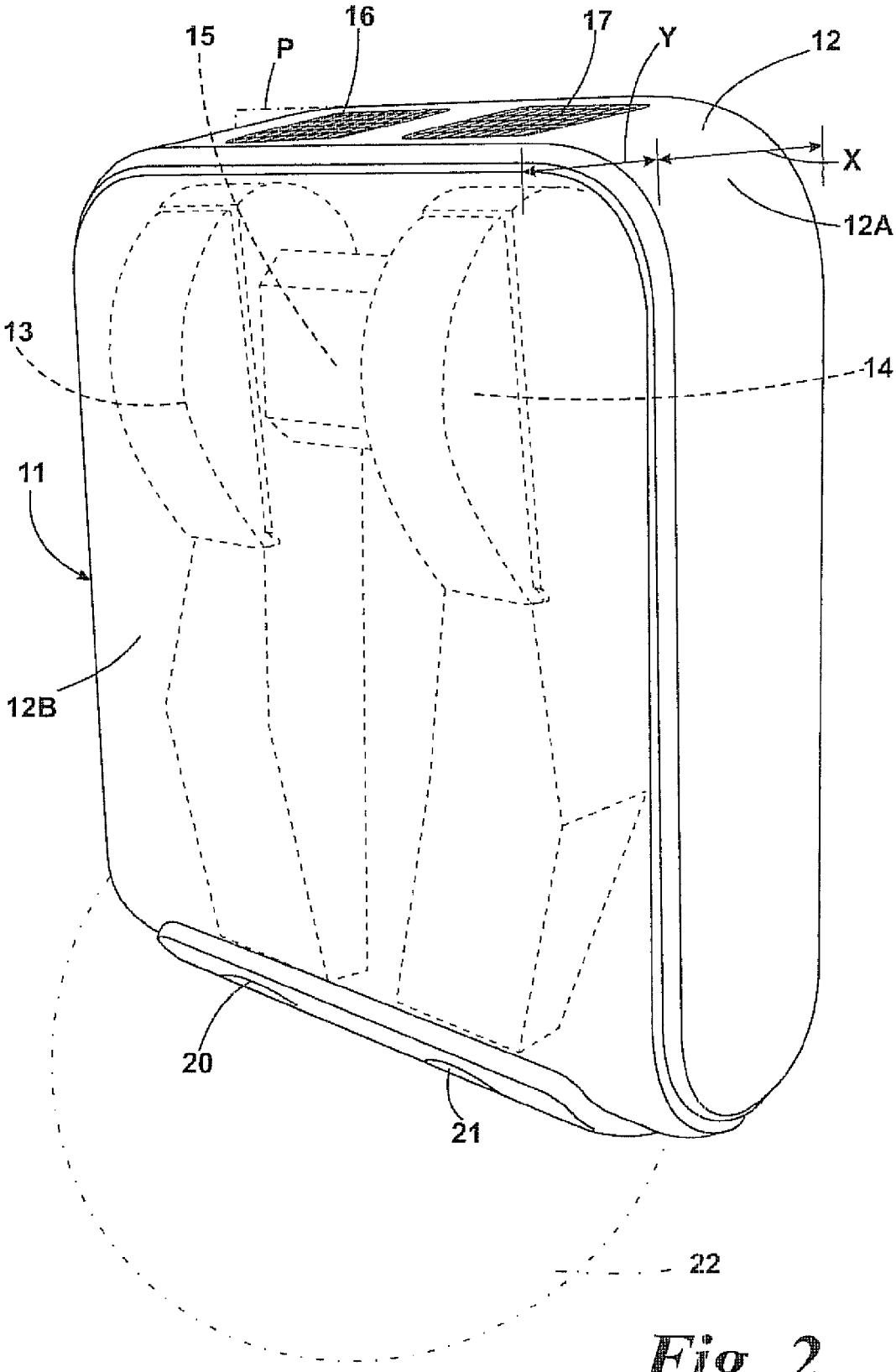
FIG. 2 is a diagrammatic view from the front and to one side (again with a partially ghosted interior) to show the internal disposition of components with the drier in working configuration.
Figure 3:
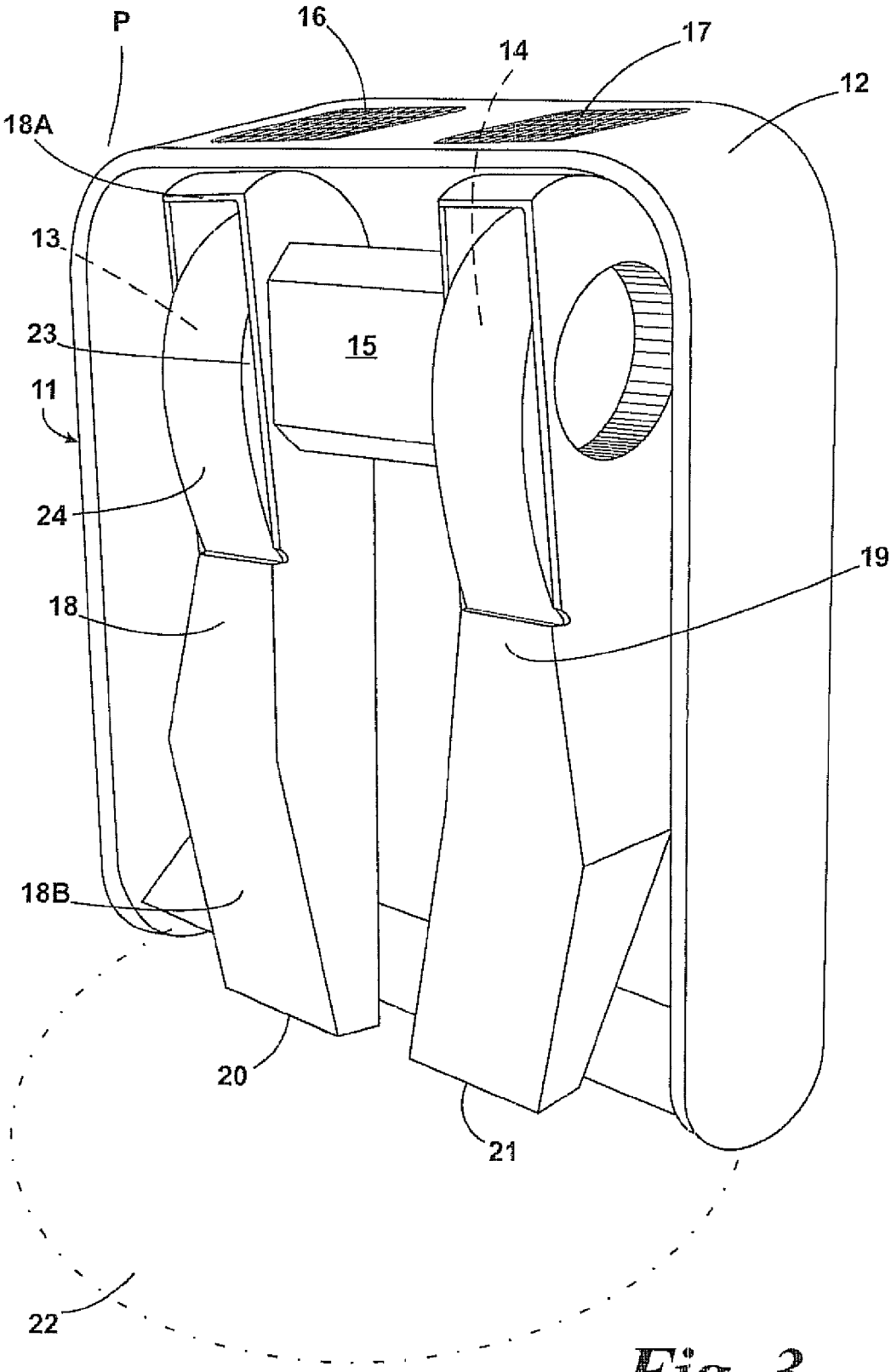
FIG. 3 is a view similar to that of FIG. 1 but with the front of the drier removed.
Figure 4:
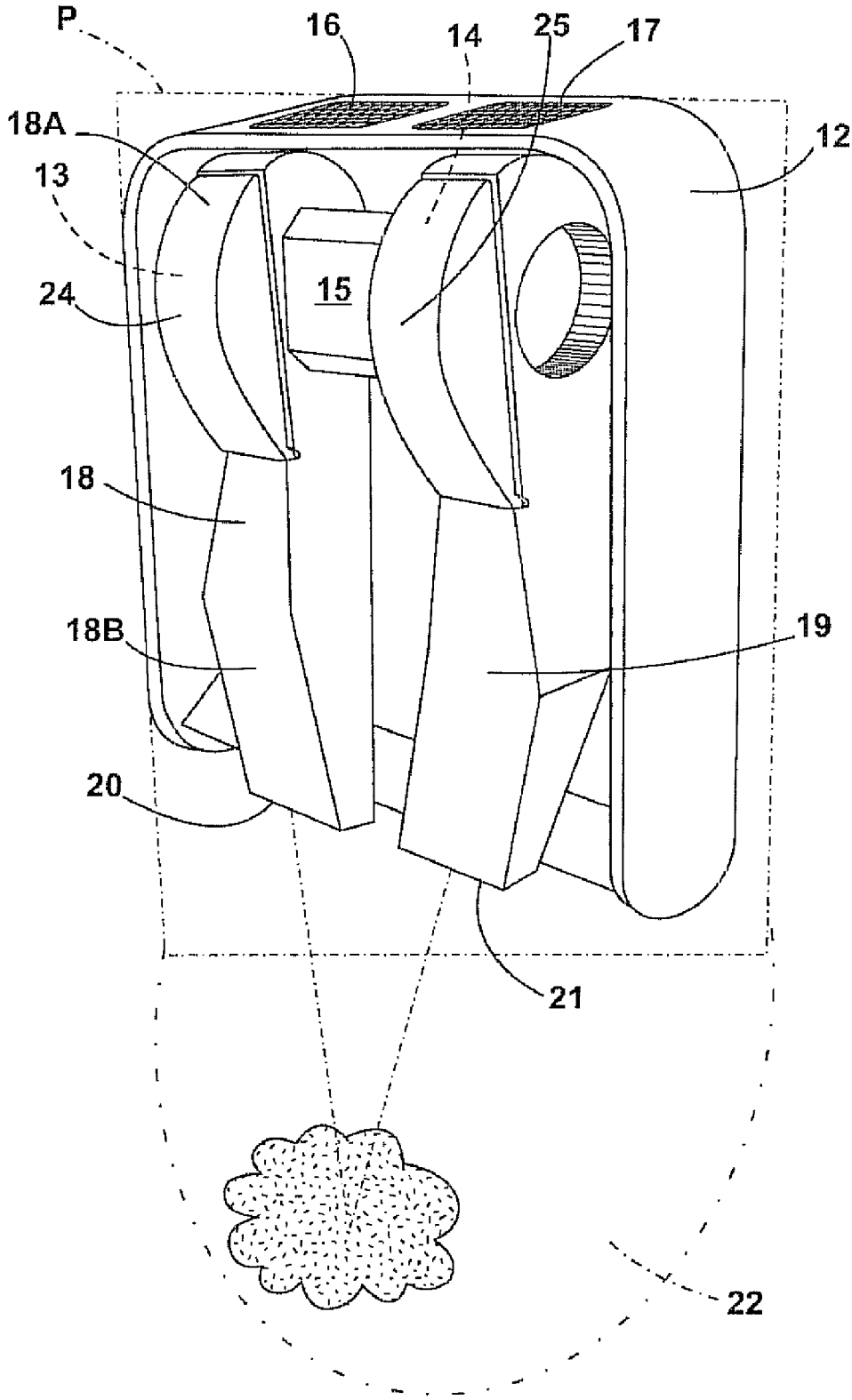
FIG. 4 is a view similar to that of FIG. 2 but with the front of the drier removed.

The housing 12 provides for the drier 11 to be movable between two operating configurations:

- a standby configuration, as shown in FIGS. 1 and 3, in which the hinged section 12B lies close set within the fixed section 12A and the drier 11 projects from the wall plane P by maximum distance X; and
- a working configuration, as shown in FIGS. 2 and 4, in which the hinged section 12B is pivoted outwardly so that its upper leading edge 25 projects from wall plane P by maximum distance of X+Y.

The means for causing the drier 11 to move between its standby and working configurations is now considered.

FIGS. 3 and 4 which, for the sake of clarity does not include pivoted front cover 12B of the drier, show components lying within the interior of the drier 11. Fan 13 is located within air duct 18. The duct 18 has an upper section 18A (not shown completely) which is coupled to air inlet 16 and a lower section 18B coupled to air outlet 20. The upper section 18A and lower section 18B are linked by a fan chamber containing fan 13 which chamber includes a scroll section 24 which is mounted at its lower end on a pivot so that the scroll section 24 can move between the standby configuration for the drier, as shown in FIG. 3, with the scroll chamber retracted and the working configuration, as shown in FIG. 4, with the scroll chamber extended.

With the components of the drier 11 initially positioned as shown in FIGS. 1 and 3 then when the fan 13 is driven by motor 15 air pressure in the fan chamber 23 rises to an extent that the scroll section 24 is driven to pivot outwardly so as to push out cover 12B until the components arrive at the configuration shown in FIG. 4. In this configuration the drier 11 is able to operate at fully capacity with a full airflow through the air duct 18. The flowing air is heated by heat exchange with an electric heater (not shown) located in the air duct 18.

FIG. 4 shows the drier 11 in operation with hands H located in drying region 22.

In this embodiment the scroll section 24 is caused to contact hinged section 12B of the housing and thereafter displace the section 12B from the standby configuration shown in FIG. 1 to the working configuration shown in FIG. 2. The required displacement of the scroll section 24 is readily caused by the initial start-up operation of the fan 13. There is no requirement for a supplementary displacing means.

The other fan 14 and its associated scroll section 25 and ducting 19 is also driven by motor 15 to and functions in a similar manner to that described in connection with fan 13 and its associated scroll section 24 and ducting 19.

Once working operation of the drier 11 has been terminated the drier 11 automatically reverts to its stand by configuration (shown in FIGS. 1 and 3) and the resiliently loaded scroll sections 24, 25 are caused to seat close to their respective fan 12, 13 as shown in FIGS. 1 and 3.

The initiation of operation of drier 11 can be achieved in a number of ways but in this case a proximity detector is located in the housing 12 to scan for the presence of an object, such as a pair of hands, in the drying region 22. When such a presence is detected the drying cycle is initiated.

INDUSTRIAL APPLICABILITY

The invention provides for an air moving device, particularly a powerful hand drier to be located in a position where its projection into its working space is kept to a minimum when not in use. On being used the heater automatically takes up an extended configuration for optimal functioning and when use is completed automatically reverts to its un-extended configuration. The concept is also applicable to other air moving devices such as such as vacuum cleaners, air conditioning units and drying apparatus for objects other than hands where it is desirable for the device to be reduced in size or amount projection when not in use or on standby but which can be increased in size or amount of projection when in use particularly when the increase provides for more effective operation.

The invention claimed is:

1. An air displacing device for transferring air from a first location to a second location, the air displacing device comprising:

- a housing including a fan, and the fan being contained within a fan chamber;
- a prime mover for rotating the fan;
- an air inlet to the housing for enabling the device to receive air from the first location;
- an air outlet from the housing for delivering air to the second location; and
- a duct for transferring air through the housing from the inlet to the outlet via the fan chamber, the fan being operable by the prime mover for causing the air to be displaced along the duct from the inlet to the outlet, and the housing having a fixed section having a plurality of walls extending outward in a first direction, distal ends of the plurality of walls serving to define a datum plane;
- wherein the housing has a displaceable member for displacement between a first, standby, configuration where the projection of the displaceable member from the datum plane is a minimum and so that a volume of the housing is a minimum, and a second, working, configuration where the projection of the housing from the datum plane is a maximum and so that the volume of the housing is a maximum; and
- the fan chamber includes a scroll section forming at least part of a wall of the fan chamber, the scroll section mounted on a pivot so that when the displaceable member is in its first, standby, configuration, the scroll section is retracted and, when the prime mover drives the fan, air displaced by the fan causes the scroll section to extend and drive the displaceable member into its second configuration.

2. The air displacing device according to claim 1, wherein the air displacing device further comprises a heating element for transferring heat into air displaced along the duct.

3. The air displacing device according to claim 1, wherein the fan is caused to have a minimum outside dimension, when the housing is in its standby configuration, and a maximum outside dimension, when the housing is in its working configuration.

4. The air displacing device according to claim 1, wherein the air displacing device further comprises at least two air inlets and at least two air outlets.

5. The air displacing device according to claim 4, wherein the air displacing device further comprises only two air inlets and two air outlets.

6. The air displacing device according to claim 4, wherein the air displacing device further comprises at least two ducts connecting the least two air inlets to the at least two air outlets.

7. The air displacing device according to claim 4, wherein each air inlet is linked to the air outlet by a separate duct.

8. The air displacing device according to claim 7, wherein each air duct includes a separate fan and a separate fan chamber.

9. The air displacing device according to claim 1, wherein the air inlet is located on an axially opposed wall of the housing from the air outlet.

10. The air displacing device according to claim 9, wherein the air duct channels the air along a substantially linear air path from the air inlet to the air outlet.

11. The air displacing device according to claim 10, wherein the scroll section extends and retracts in a direction substantially perpendicular to the air path.

12. An air displacing device for transferring air from a first location to a second location, the air displacing device comprising:

a housing including a fan, and the fan being contained within a fan chamber;

a prime mover for rotating the fan;

an air inlet to the housing for enabling the device to receive air from the first location;

an air outlet to the housing for delivering air to the second location; and a duct for transferring air through the housing from the inlet to the outlet through the fan chamber, the fan being operable by the prime mover for causing the air to be displaced along the duct from the inlet to the outlet, and the housing having a fixed section having a plurality of walls extending outward in a first direction, distal ends of the plurality of walls defining a datum plane;

wherein the housing has a displaceable member adapted for displacement between a first, standby, configuration where a projection of the displaceable member from the datum plane is at a minimum amount so that a total volume of the housing is a minimum, and a second, working, configuration where the projection of the displaceable member from the datum plane is at a maximum amount so that the volume of the housing is a maximum; and the fan chamber includes a scroll section forming at least part of a wall of the fan chamber, the scroll section mounted on a pivot so that when the displaceable member is in the first, standby, configuration, the scroll section is retracted and located adjacent the datum plane and, when the prime mover drives the fan, the air displaced by the fan causes the scroll section to extend and move away form the datum plane and drive the displaceable member to the second configuration.

* * * * *